US007979925B2

(12) United States Patent
Karbowski

(10) Patent No.: US 7,979,925 B2
(45) Date of Patent: Jul. 19, 2011

(54) PORTABLE INFANT WASHING TUB

(76) Inventor: Tom Karbowski, Lake Worth, FL (US)

( * ) Notice: Subject to any disclaimer, the term of this patent is extended or adjusted under 35 U.S.C. 154(b) by 1251 days.

(21) Appl. No.: 11/638,903

(22) Filed: Dec. 14, 2006

(65) Prior Publication Data

US 2008/0141452 A1 Jun. 19, 2008

(51) Int. Cl.
*A47K 3/024* (2006.01)

(52) U.S. Cl. ..... 4/572.1

(58) Field of Classification Search ..... 4/553, 559, 4/572.1, 579

See application file for complete search history.

(56) References Cited

U.S. PATENT DOCUMENTS

| | | | | | |
|---|---|---|---|---|---|
| 937,476 | A * | 10/1909 | Shipp | 4/572.1 |
| 1,019,212 | A * | 3/1912 | Yates | 4/583 |
| 1,159,507 | A * | 11/1915 | Lang | 4/558 |
| 1,512,068 | A * | 10/1924 | Thornburg | 4/572.1 |
| 2,495,482 | A * | 1/1950 | Rogatz | 4/572.1 X |
| 5,926,866 | A | 7/1999 | Chao | |
| 5,946,745 | A * | 9/1999 | Magee | 4/516 X |
| 5,974,601 | A | 11/1999 | Drane et al. | |
| 6,112,343 | A * | 9/2000 | Dixon | 4/572.1 |
| 6,243,890 | B1 | 6/2001 | Yang | |
| 6,578,209 | B2 | 6/2003 | Lopes et al. | |
| 6,785,917 | B1 | 9/2004 | Bryant | |
| 7,032,259 | B1 | 4/2006 | Kilion | |
| 7,058,995 | B2 | 6/2006 | Sundberg et al. | |
| 2005/0066436 | A1 * | 3/2005 | Mazar | 4/538 |

* cited by examiner

*Primary Examiner* — Lori Baker

(74) *Attorney, Agent, or Firm* — McHale & Slavin, P.A.

(57) ABSTRACT

A movable apparatus for bathing infants and small children therein which includes a tub section having a cavity for supporting an infant during bathing and a storage section, a filling means in fluid communication with the cavity for introducing water into said cavity, a drain in fluid communication with said cavity for removing water from the cavity the tub section further including a separator separating the cavity and the storage section a seat removably mounted to a bottom portion of said cavity the seat designed to securely hold an infant during bathing legs pivotally secured to a bottom portion of the tub section the legs extending downwardly from the bottom portion of the tub section and supporting the tub section at a height such that a person using said apparatus does not have to bend over to bathe an infant in the tub section.

19 Claims, 5 Drawing Sheets

PORTABLE INFANT WASHING TUB

FIELD OF THE INVENTION

The present invention relates to infant bathtubs provided with legs so that the user does not have to bend over to wash a child or infant. The bathtub is also provided with a removable seat so that the user does not have to hold the infant while bathing the infant.

BACKGROUND OF THE INVENTION

An infant's muscles are not strong enough to support its body, so it is important that a parent or caregiver carefully hold and support the infant when giving the infant a bath. When giving the infant a bath the parent must hold the infant in one arm and bath the infant with the other, so that the infant is protected and water is prevented from entering the infant's eyes, ears, mouth or nose. In many instances the infant is not comfortable and is wiggling or squirming. This is very difficult if the infant is being bathed in a conventional bathtub. Another problem with bathing an infant is the ready access to the necessities such as soap, shampoo, towels, clean cloths, etc. There needs to be provisions made for the ready access of these necessities so that the parent or caregiver does not have to reach too far and lose their grip on the infant.

A small child is also not able to bathe themselves and therefore an adult or caregiver must bathe the child. This task is usually preformed in a conventional bathtub. The adult must get down on their knees and bend over the side of the bathtub to bathe the child and make sure that the child does not slip and hurt themselves. This task becomes very difficult when the adult has physical problems, such as knee or back problems, is obese or elderly.

DESCRIPTION OF THE PRIOR ART

The use of infant bathtubs with removable seats is known in the prior art. U.S. Pat. No. 6,785,917 discloses an infant bathtub with a removable seat. The removable seat is attached to the rear wall of the bathtub in a manner so that the infant is placed in a seated upright position during the bathing process. There is also a securement member to retain the infant in the seat. The bathtub is usually placed near a source of water to fill the tub. After the tub is filled with water the infant is placed in the seat in the tub and bathed. The infant is then removed from the tub, dried off and dressed. Since there is no drain in the tub it must be tipped over to remove the water. As a result it is most likely that the infant tub will be placed within a conventional bathtub to promote filling and draining of the infant tub. When the infant bathtub is placed within a conventional bathtub the parent or adult that is bathing the infant is required to get down on their knees and bend over to bathe the infant. The instant invention overcomes this problem by raising the infant bathtub to a height wherein an adult can bathe a child while standing.

U.S. Pat. No. 5,926,866 discloses a bathtub for a baby which includes a support net in the bathtub for the baby. The bathtub is filled with water and the baby is bathed. The water may be drained from the bathtub into a water pot prior to the baby being removed from the bathtub. The water pot can then be taken to a sink or tub and the water dispensed of. The entire baby bathtub does not have to be moved to drain the water therefrom. While the baby bathtub has wheels to provide for ease of movement from one location to another, the height of the bathtub still requires an adult to bend over to bathe a baby or child. The instant invention overcomes this by raising the tub to a height at which an adult can bathe a child comfortably. Also, a filling connection and a drain are provided on the instant invention so that the bathtub can be filled and drained without moving the bathtub or carrying water to the tub.

U.S. Pat. No. 6,243,890 discloses a bathtub for babies which includes a pad or seat for supporting the baby during the bathing procedure. The bathtub is also provided with removable legs to support the bathtub at various heights conforming to the height of an adult bathing the baby. These legs comprise members of differing lengths. The members are assembled to provide the desired height and then the assembly is attached to each corner of the bathtub to support the bathtub at the desired height.

SUMMARY OF THE INVENTION

The instant invention is designed to overcome problems associated with bathing an infant or child in a conventional bathtub. Although a small bathtub or infant holding device may be used to bathe infant, these devices are normally placed inside of a conventional bathtub. There are many instances when an adult is unable to bend over a conventional bathtub to bathe an infant or child because of physical problems such as knee or back problems. In addition, the instant invention is designed for elderly grandparents, pregnant women, obese persons, and any other persons who find it difficult to get down to the level of a conventional bathtub. The instant invention overcomes these problems by raising the infant bathtub to a height at which an adult is able to bathe an infant or small child while standing.

Accordingly, it is an objective of the instant invention to provide a bathtub for infants and children which enables a person to bathe the child in a substantially upright position.

It is a further objective of the instant invention to provide a bathtub for infants and children which can be readily set up for use, taken down and stored away.

It is yet another objective of the instant invention to provide a bathtub for infants and children which is provided with a removable seat to hold an infant during the bathing process.

It is a still further objective of the invention to provide a bathtub for infants and children including foldable legs which enable the bathtub to be stored easily.

It is yet a further objective of the invention to provide a support frame which enables the bathtub to be hung on a conventional door.

It is still a further objective of the invention to provide a belt securable to the bathtub to assist in holding a child in the bathtub.

It is still yet another objective of the invention to provide a bathtub with an impeller to assist in draining water from the bathtub.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
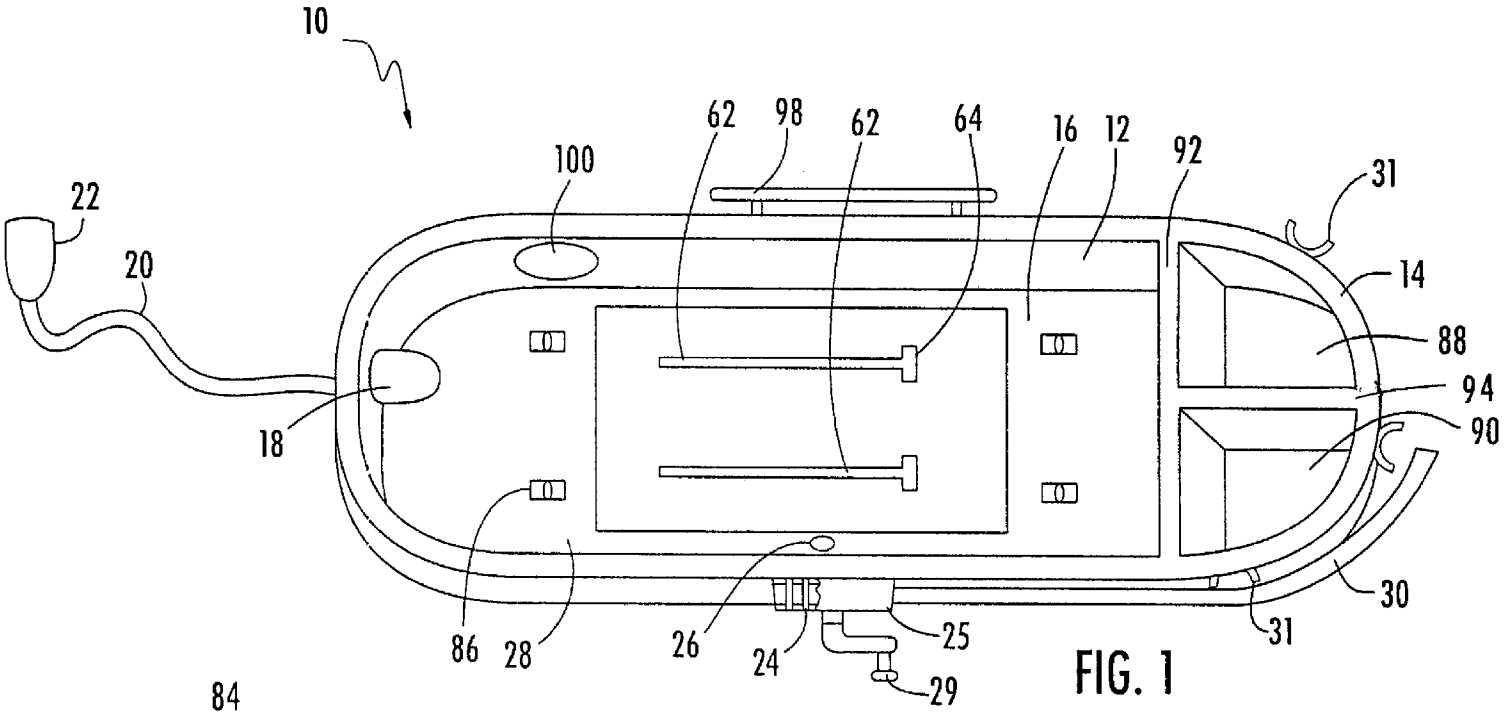
FIG. 1 is a top perspective view of a preferred embodiment of the present invention including a cut away portion of the impeller housing.

With reference to the drawings and in particular to FIGS. 1-15, a new collapsible bathtub for infants and small children embodying the principles and concepts of the present invention and generally designated by the reference numeral 10 will be described.

Figure 2:
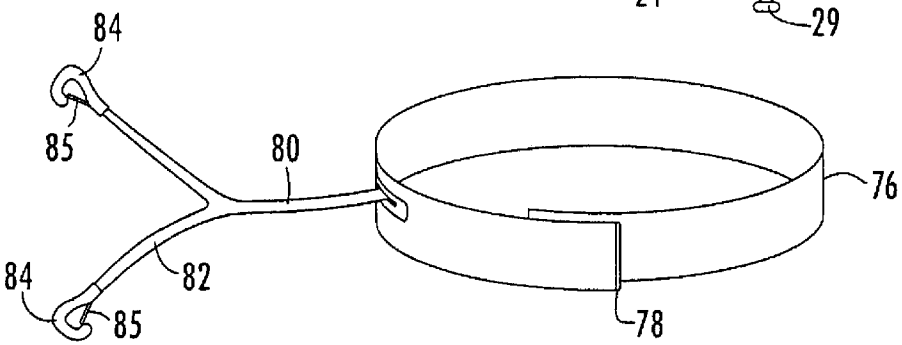
FIG. 2 is a perspective view of a retention belt.
Figure 3:
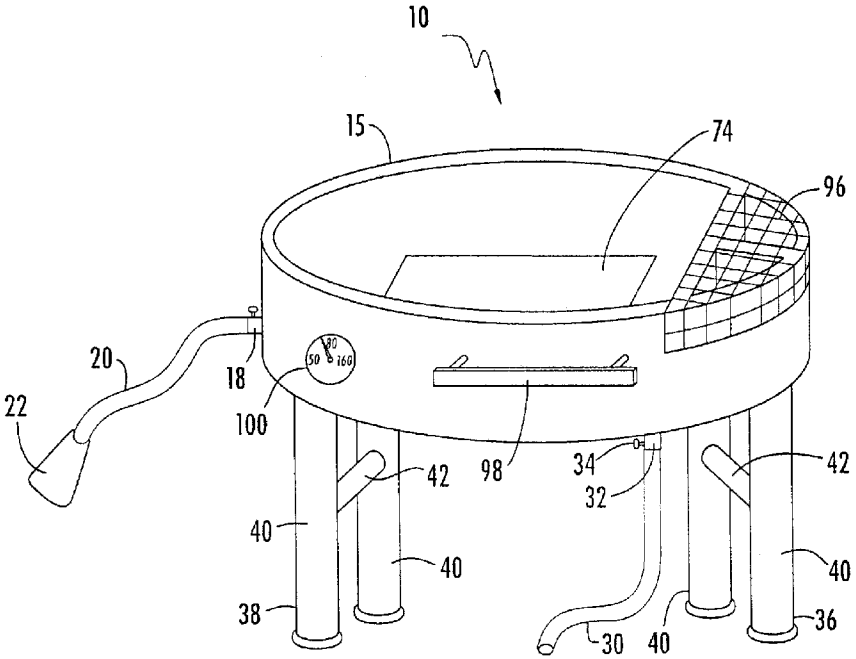
FIG. 3 is a front perspective view of the present invention.

Referring initially to FIGS. 1-15, the portable, collapsible bathtub 10 includes a tub section 12 and a storage section 14. The tub section 12 has a centrally disposed longitudinal axis and defines a cavity 16 for supporting an infant or a small child during bathing operations. The cavity 16 includes an inlet 18 for the introduction of water or other fluid into the cavity. Inlet 18 is connected to a filling hose 20 which has an adapter 22 located at the other end thereof. Adapter 22 is constructed and arranged to be attached to a faucet of a sink in a house. The sink may be located in a bathroom, the kitchen, or laundry room. The adapter 22 fits over the faucet in a fluid tight manner to allow water from a faucet to be utilized to fill the bathtub. The adapter may also be a threaded fluid tight fitting which replaces the aerator of a faucet or is connectable to a faucet which is provided with a threaded fluid connection. Any conventional adapter can be employed to connect the filling hose 20 to a source of water. Connecting the filling hose to a sink in a house permits the introduction of both hot and cold water into the bathtub so the temperature of the bath water may be regulated. The inlet 18 can also be provided with an open/close valve 19 to permit or restrict the flow of water into the cavity 16. A flange 15 is located along the top portion of the tub section 12 and storage section 14, as shown in FIG. 3. This flange extends perpendicularly outwardly from the tub and storage sections and includes an upper and lower surface. This flange is used to hold the bathtub in its storage position as will be described hereinafter.

Figure 15:
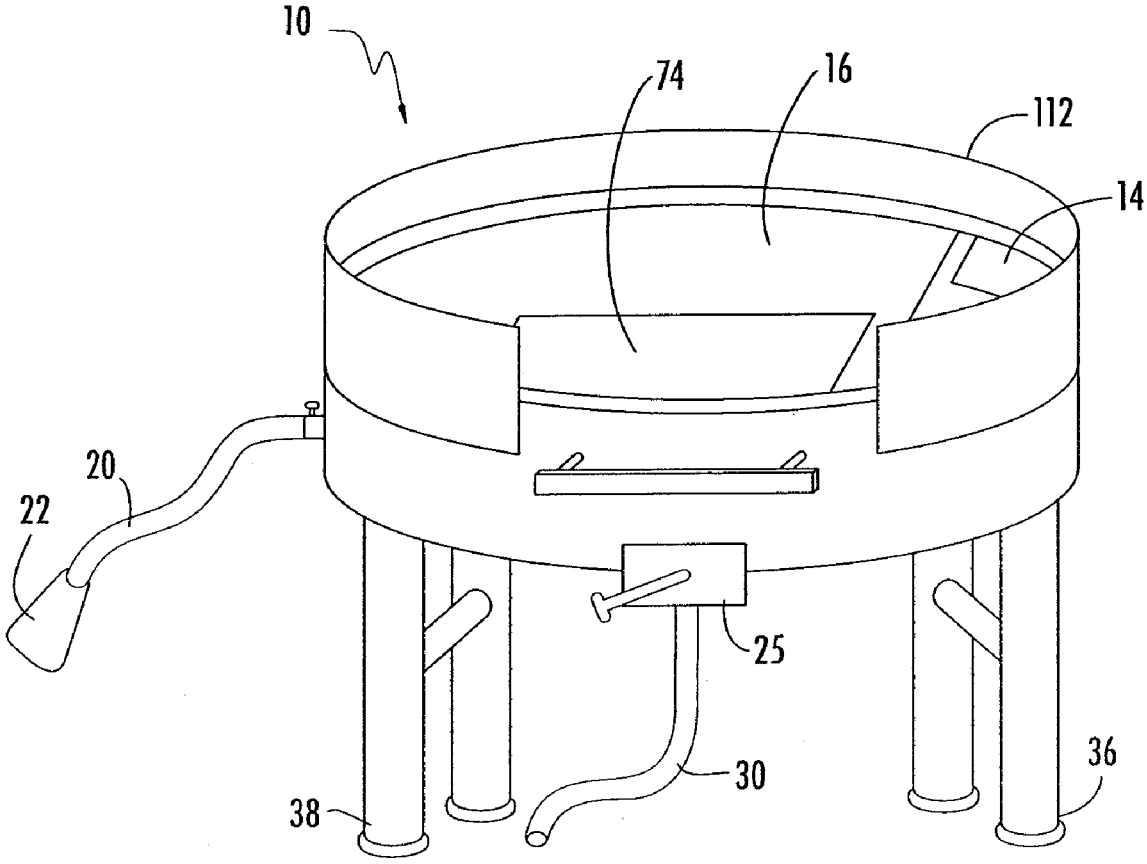
FIG. 15 is a front perspective view of another embodiment of the present invention.

The water is drained from the tub section utilizing an impeller or paddle wheel 24 which is mounted in housing 25, as illustrated in FIGS. 1 and 15. A drain opening 26 is located in the bottom surface 28 of the cavity adjacent the housing 25 and fluidly connected to the impeller 24 mounted in the housing 25. A hose 30 is connected to an outlet of housing 24 to convey the water, which has been drained from the cavity, to a drain connected to the plumbing system of a house or business and away from the premises. Clips or snaps 31 are attached to the outside portion of the bathtub and secure hose 30 adjacent the bathtub when it is not in use. Crank 29 is connected to the impeller and permits a person to turn the impeller 24 and drain the water from the cavity 16. The bottom surface 28 of cavity 16 is preferably sloped downwardly toward the drain opening 26 to enable all of the water in the bathtub to be drained therefrom. An alternative type of drain is illustrated in FIG. 3. In this embodiment drain valve 32 is connected to the outlet 26 of the cavity. The drain valve is provided with an open/close valve 34 which maintains the water in the tub or permits it to be drained therefrom through hose 30.

Alternatively, hose 30 could be connected to a supply of water and the cavity could be filled with water supplied from the tube 30 through housing 25 and opening 26.

Figure 6:
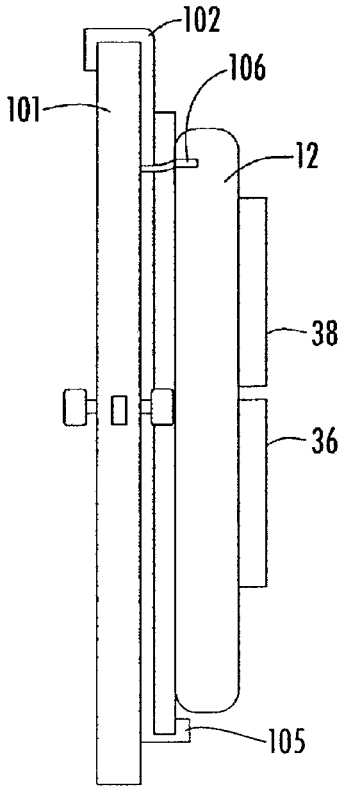
FIG. 6 is a side view of the present invention mounted on a support which is supported on a door.
Figure 7:
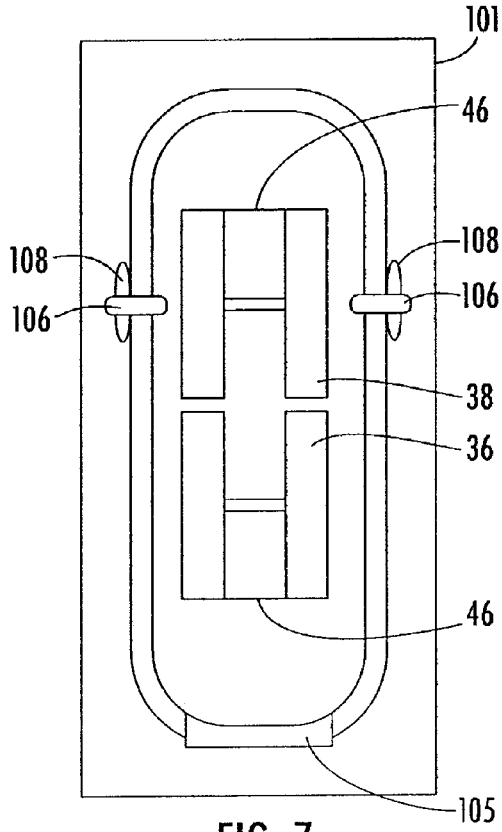
FIG. 7 is a front view of the present invention illustrated in Gig. 6.
Figure 8:
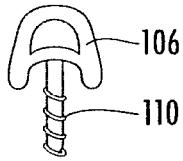
FIG. 8 is a perspective view of an attachment device.
Figure 10:
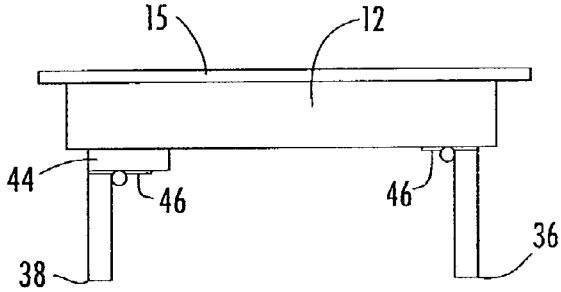
FIG. 10 is a side view of the present invention illustrating an alternative embodiment for mounting the leg members.

The portable bathtub 10 is supported by leg members 36 and 38, as illustrated in FIGS. 3, 10 and 15. Each of the leg members preferably comprise two leg elements 40 which are connected by a transverse member 42 (FIG. 3). The leg members 36, 38 are attached to the bottom of the bathtub 10, extend downwardly therefrom and provide support for the bathtub. While the leg members are shown as being attached to the bottom of the bathtub by hinges they could also be secured to the bathtub by other well known attachment means such as being removably attached to protrusions extending from the bottom of the bathtub or inserted into apertures in the bottom of the bathtub (not shown). The leg members could also be telescoping and attached to the bottom of the bathtub (not shown). They could also be secured to the bottom of the bathtub by screws or other fastening means (not shown). The length of the leg members permit the bathtub to be elevated from the ground to a height which allows a person to comfortably bathe an infant or child without having to bend over. When the bathtub is to be stored away, the leg members are folded up adjacent the bottom of the bathtub, as illustrated in FIGS. 6 and 7. Normally the length of the leg members is such that they can be both folded adjacent the bottom of the bathtub without overlapping each other. However, in certain circumstances, the height of the bathtub needs to be raised above its normal operating height. For example is the person bathing the infant is very tall. In this situation the leg members must be longer than normal. This does not allow the leg members to both fold up adjacent the bottom of the bathtub without overlapping each other. To overcome this problem one of the leg members, 38 in FIG. 10, is mounted on a spacer 44. The height of the spacer is equivalent to the thickness of the opposing leg member 36. This arrangement allows leg member 36 to be first folded upward adjacent the bottom of the bathtub and then leg member 38 folded up towards the bottom of the bathtub and a lower portion of leg member 38 to rest on top of a portion of leg member 36. This arrangement permits both leg members to be parallel to the bottom portion of the bathtub when in the storage position.

Figure 9:
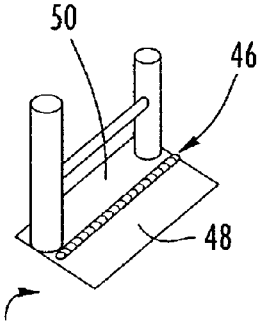
FIG. 9 is a perspective view of a pair of leg members including a hinge mount.

FIG. 9 illustrates the preferred embodiment for mounting the leg members 36, 38 to the bathtub 10. A hinge 46 is mounted on the bathtub and the leg members are also attached to the hinge. Portion 48 of hinge 46 is secured to the bottom of the bathtub 12 or to spacer 44 (FIG. 10). Leg members 36 and 38 are then secured to portion 50 of the hinge 46. This arrangement permits the leg members to be swung from their position supporting the bathtub, as illustrated in FIGS. 3, 10 and 15, to a storage position, as illustrated in FIGS. 6 and 7. Hinges 46 are provided with a means to lock them in their full open position and in a position wherein portions 48 and 50 are substantially perpendicular to each other. This enables the leg members to be locked in the operative position (FIG. 3) and in their storage position (FIG. 7).

Figure 4:
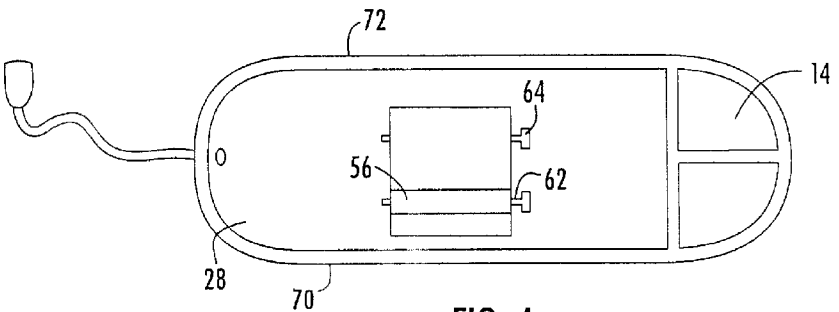
FIG. 4 is a top view of the invention with the child support seat installed.
Figure 5:
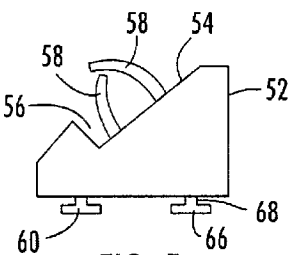
FIG. 5 is a side view of the child support seat.

A removable seat 52 allows a person to bathe an infant without having to hold the infant. The seat 52 is constructed so that an infant can be placed on their back in an inclined position. The infant's back rests against back rest portion 54 of the seat 52. A seat member 56 is positioned substantially perpendicular to the back rest portion and provides a seat for the infant. Securing straps 58 are attached to the seat and are securable around the infant the help hold the infant in the seat 52. The bottom of the seat is provided with "T" shaped slides 60. The bottom surface 28 of cavity 16 is provided with a plurality of slots or tracks 62 therein. These slots are constructed and arranged to mate with the slides 60 on the bottom of the seat member 56 and secure the seat to the cavity. Each of the slots or tracks 62 is provided with an enlarged portion 64 at one end thereof. This enlarged portion enables the slides 60 to be inserted into the tracks 62. Each of the slides 60 are formed with a wide portion 66 and a narrow portion 68. The wide portion 66 of the slides is passed through enlarged portion 64 of the slot 62. The narrow portion 68 of the slides engage slot 62 and prevents movement of the seat from one side 70 of the tub to the other side 72 thereof (FIG. 4). The upper portion of the wide portion 66 of the slides 60 engage the bottom of the tracks 62 and prevent the seat from disengaging the bottom of the bathtub. With this construction the infant seat 52 can be readily attached to the bathtub when necessary and removed from the bathtub for storage. The seat is positioned in the bathtub such that the infant faces one side, 70, of the tub or the other. In a preferred embodiment the height of the seat member is such that it does not extend above the top of the sides of the tub section 12.

When the seat is not being used a mat 74 is placed on the bottom of the cavity providing a cover for the tracks 62. The mat prevents water from entering the tracks. The mat 74 also provides a surface on which a small child can sit or stand without the danger of possibly slipping on the bottom surface 28 of cavity 16.

An adjustable waist belt 76 is available to help prevent small children from standing up falling out of the bathtub during the bathing process. The waist belt would normally be placed around the waist of a small child and the ends thereof would be secured with hook and loop type fasteners 78. A tether 80 is attached to a portion of the waist belt. The tether is provided with a plurality of branches 82. Each of the branches is provided with a hook or clip 84 at an end thereof. Each hook 84 is provided with a retainer 85. The retainer 85 is resiliently held in a normally closed position, as shown in FIG. 2. The bottom 28 of the cavity is provided with anchors 86 for the hooks 84. The anchors are preferably slots with a pin secured across the slot. The hooks 84 are attached to the pins and the retainers 85 prevent the hooks from releasing from the pins.

The storage section 14 of the bathtub 10 is preferably divided into two separate bins 88 and 90. The storage section is separated from the cavity by a wall 92. The wall is fluid tight so that the storage section remains dry. Another wall 94 divides the storage section 14 into two separate bins 88 and 90. These bins are utilized to hold items which are used during the bathing process such as soap, shampoo, wash cloths, towels, toys, etc. The open tops of the bins 88 and 90 may be closed by a net 96, FIG. 3, which is placed over the open tops and secured to the sides of the bathtub and wall 92. The net helps to retain the items placed in the bins when the bathtub is placed in its vertical storage position as will be described hereinafter. In place of the net, other equivalent devices could be used to close the open tops of the bins.

The bathtub 10 is additionally provided with a towel rack 98 for hanging a wet or dry towel thereon. This places the towel within easy reach of the person bathing the infant or small child. Clothing for the child may also be placed on the towel rack 98. A thermometer 100 is built into the side of the bathtub. This enables the person filling the bathtub with water to control the amounts of hot and cold water supplied to the bathtub so that the bath water temperature will not be too hot or cold for the infant or small child.

Figure 11:
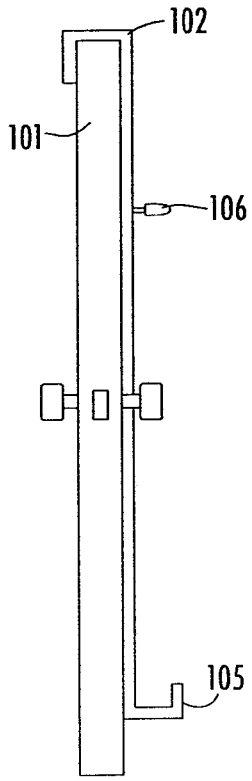
FIG. 11 is a side view of the support mounted on a door.
Figure 12:
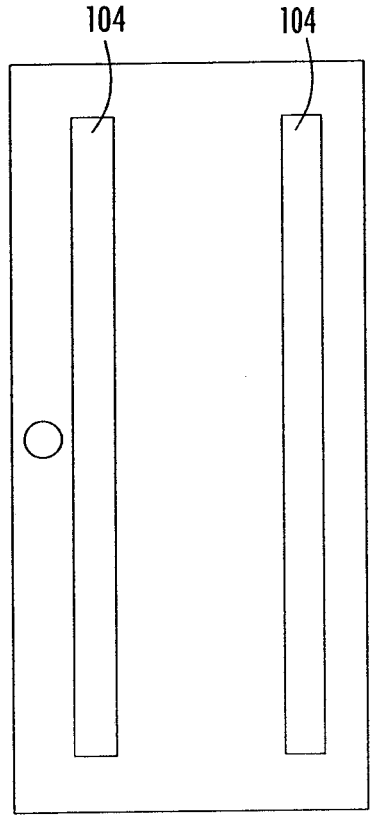
FIG. 12 is a front view of a door illustrating the attachment means for the support.
Figure 13:
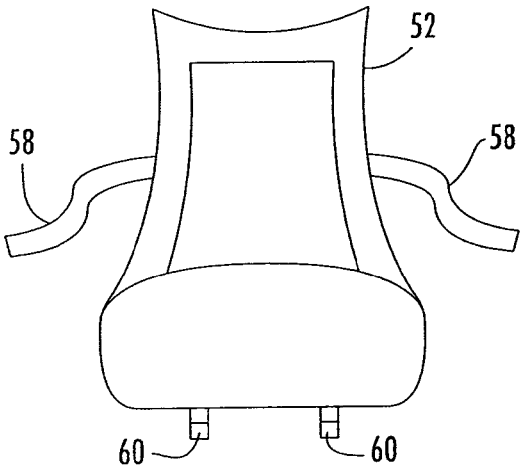
FIG. 13 is a front view of another child support seat usable with the present invention.
Figure 14:
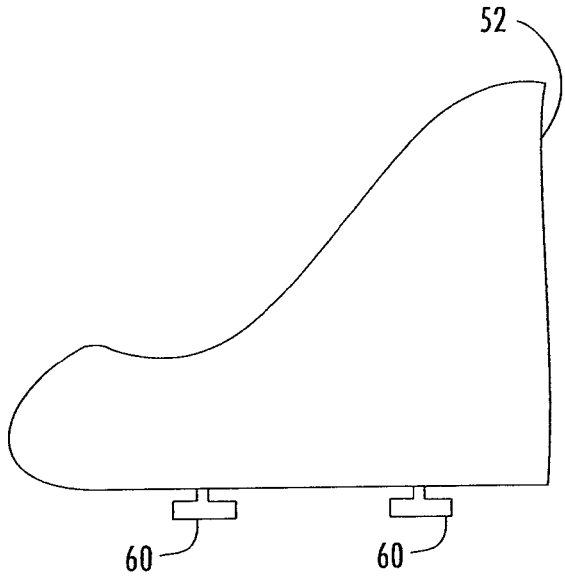
FIG. 14 is a side view of the seat illustrated in FIG. 13.

When the bathtub is not is use it can be stored be stored on a door 101 as illustrated in FIGS. 6 and 7. After the water is emptied from the bathtub the leg members 36 and 38 are folded up against the bottom of the bathtub. The leg members are held in place by hinges provided with means to maintain the hinges in a substantially 90 degree position. A storage rack 102 is hung over the top of a door 101 and rests along a surface thereof (FIG. 11). The bathtub is then placed onto the storage rack with the upper portion of the tub section 12 and the flange 15 adjacent the door. The storage rack 102 is held in position adjacent the door by the use of hook and loop fasteners 104 which are attached to one side of the door and the storage rack. The lower portion of the storage rack is provided with a flange 105 which engages a portion of the flange 15 at one end of the bathtub. The flange 105 provides vertical support for the bathtub and retains the bottom end portion against the support rack. Two retention clips 106 are positioned on opposite sides of the storage rack adjacent an upper portion thereof. When the retention clips are not in use they are retained in grooves 108 (FIG. 7). Springs 110 attached to the clips 106 and support rack 102 resiliently retain the clips against the support rack and against the lower surface of the bathtub flange 15. These grooves position the clips so that the bathtub can be placed on the support rack without interfering with the clips. Once the bathtub is in position on the support rack the clips are pulled outwardly from the groove 108, turned 90 degrees and placed against the lower surface of the flange 15 of the bathtub. This secures the upper portion of the bathtub to the support rack 102. When the bathtub is to be placed in use, the clips 106 are disengaged from the flange 15 of the bathtub and the bathtub is lifted up and free from flange 105 thus enabling the bathtub to be removed from the storage rack and the door. Since the seat member 52 does not extend above the height of the tub section 12 it can be placed into the tub section during storage of the bathtub.

In an alternative embodiment the bathtub 12 can be provided with a screen 112 which substantially surrounds the outer perimeter of the bathtub (FIG. 15). Means are provided for readily attaching the screen 112 to the outer perimeter of the bathtub and removing it therefrom. In this embodiment a small pet can be bathed in the bathtub without splashing water all over the surrounding area.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A movable apparatus for bathing infants and small children therein comprising:

a tub section comprising a cavity for supporting an infant during bathing and a storage section, at least one elongate track located in said bottom portion of said cavity;

said tub section including a hose for filling and an impeller for draining said cavity, said hose and said impeller in fluid communication with said cavity;

a seat member removably engaged to a bottom portion of said cavity, at least one slide member mounted on the lower portion of said seat member;

said at least one elongate track constructed and arranged to removably receive said at least one slide member whereby said seat is secured to the bottom portion of said cavity;

said seat member constructed and arranged to securely hold an infant during bathing; and deployable leg members pivotally engagable with a bottom portion of said tub section for supporting said tub section at a desired height, whereby a person using said apparatus does not have to bend over to bathe an infant in said tub section.

2. The apparatus of claim 1 wherein said slide members are substantially "T" shaped and said elongate tracks are correspondingly shaped to receive said slide members and permit said slide members to readily traverse said elongate tracks.

3. The apparatus of claim 1 wherein said seat member further includes a securing member constructed and arranged to be fastened about an infant seated in said seat member during said bathing.

4. The apparatus of claim 1 wherein said leg members are constructed and arranged to pivot in pairs between an extended position supporting said apparatus above a surface and a retracted position juxtaposed a bottom surface of said apparatus;

said leg members being arranged so that when said leg members are in said retracted position said leg members do not overlap each other.

5. The apparatus of claim 4 wherein one pair of said leg members is mounted on a spacer secured to the bottom of said tub section and the other pair of leg members is mounted directly to the bottom of said tub section.

6. The apparatus of claim 1 wherein said apparatus further comprises a flange positioned around and attached to the top of the outer circumference of said tub section;

said flange including an upper and a lower surface and extending radially outwardly from said tub section in a direction substantially parallel to said bottom portion of said tub section.

7. The apparatus of claim 6 further comprising a tub storage rack;

retention members mounted on said tub storage rack;

said retention members being adapted to cooperate with said flange to secure said apparatus to said tub storage rack.

8. The apparatus of claim of claim 7 further comprising means for removably mounting said tub storage rack on a door.

9. The apparatus of claim 1 wherein said seat member does not extend above an uppermost portion of said tub section when said seat member is installed in said tub section in its operational position.

10. The apparatus of claim 1 further comprising an adjustable belt constructed and arranged to be secured around a small child's torso and also secured to said tub section.

11. The apparatus of claim 1 further comprising a slip-resistant surface removably positioned along a bottom surface of said cavity.

12. The apparatus of claim 1 wherein said tub section further comprises a storage section adjacent said cavity;

said storage section constructed and arranged to permit access thereto from the top of said storage section.

13. The apparatus of claim 12 further including a net extending across the top of said storage sections for retaining items placed in said storage sections.

14. The apparatus of claim 1 further including a temperature measuring device in communication with said cavity; said temperature measuring device having an output visible by a person using said apparatus.

15. The apparatus of claim 6 further comprising a storage rack constricted and arranged to be mounted on a door;

said storage rack including a retention flange mounted on a lower portion of said storage rack;

said storage rack further including retention clip members mounted on an upper portion of said storage rack;

said retention flange and said retention clip members cooperating with said flange extending from the top portion of said tub section to releasably secure said apparatus to said storage rack.

16. The apparatus of claim 15 wherein said retention clip members comprise rotatable clips, secured to said storage rack;

said clips being rotatable between a first position storage position and a second position wherein a portion of said clips engages said flange of said apparatus and secures said apparatus to said storage rack.

17. The apparatus of claim 1 further comprising a screen attachable to an outer portion of said tub section and extending substantially around the periphery of said tub section;

said screen constructed and arranged to prevent water from being splashed from said tub section onto an area surrounding said apparatus.

18. A movable apparatus for bathing infants and small children therein comprising:

a tub section comprising a cavity for supporting an infant during bathing and a storage section, a flange positioned around and attached to the top of the outer circumference of said tub section;

said flange including an upper and a lower surface and extending radially outwardly from said tub section in a direction substantially parallel to said bottom portion of said tub section;

said tub section including a hose for filling and an impeller for draining said cavity, said hose and said impeller in fluid communication with said cavity;

a seat member removably engaged to a bottom portion of said cavity;

said seat member constructed and arranged to securely hold an infant during bathing;

deployable leg members pivotally engagable with a bottom portion of said tub section for supporting said tub section at a desired height, whereby a person using said apparatus does not have to bend over to bathe an infant in said tub section; and a tub storage rack;

retention members mounted on said tub storage rack;

said retention members being adapted to cooperate with said flange to secure said apparatus to said tub storage rack.

19. A movable apparatus for bathing infants and small children therein comprising:

a tub section comprising a cavity for supporting an infant during bathing and a storage section, a flange positioned around and attached to the top of the outer circumference of said tub section;

said flange including an upper and a lower surface and extending radially outwardly from said tub section in a direction substantially parallel to said bottom portion of said tub section;

said tub section including a hose for filling and an impeller for draining said cavity, said hose and said impeller in fluid communication with said cavity;

a seat member removably engaged to a bottom portion of said cavity;

said seat member constructed and arranged to securely hold an infant during bathing;

deployable leg members pivotally engagable with a bottom portion of said tub section for supporting said tub section at a desired height, whereby a person using said apparatus does not have to bend over to bathe an infant in said tub section; and a storage rack constricted and arranged to be mounted on a door;

said storage rack including a retention flange mounted on a lower portion of said storage rack;

said storage rack further including retention clip members mounted on an upper portion of said storage rack;

said retention flange and said retention clip members cooperating with said flange extending from the top portion of said tub section to releasably secure said apparatus to said storage rack.

* * * * *